United States Patent [19]

Muelbeck

[11] Patent Number: 4,812,349

[45] Date of Patent: Mar. 14, 1989

[54] SHEET OF ROOFCOVERING MATERIAL

[76] Inventor: Martin Muelbeck, 5522 Pfaffstaedt 10, Austria

[21] Appl. No.: 56,844

[22] Filed: Jun. 3, 1987

[30] Foreign Application Priority Data

Jun. 25, 1986 [NL] Netherlands ..... 8601657

[51] Int. Cl.[4] ..... B32B 3/24; B32B 11/10; D06N 5/00; E04D 5/12

[52] U.S. Cl. ..... 428/138; 428/58; 428/141; 428/189; 428/198; 428/200; 428/201; 428/210; 428/489; 428/920; 428/921

[58] Field of Search ..... 428/138, 141, 198, 200, 428/201, 210, 489, 920, 189, 921

[56] References Cited

U.S. PATENT DOCUMENTS

| | | | |
|---|---|---|---|
| 206,436 | 7/1878 | Greene | 428/138 |
| 1,096,579 | 5/1914 | Wardell | 428/138 |
| 1,788,121 | 1/1931 | Overbury | 428/141 |
| 3,180,783 | 4/1965 | Walker et al. | 428/489 |
| 3,996,401 | 12/1976 | Van Nechel | 428/141 |
| 4,351,873 | 9/1982 | Davis | 428/489 |
| 4,565,724 | 1/1986 | Smits | 428/138 |
| 4,599,258 | 7/1986 | Hageman | 428/141 |
| 4,617,221 | 10/1986 | Von der clays | 428/489 |
| 4,618,521 | 10/1986 | Ruhl et al. | 428/489 |

FOREIGN PATENT DOCUMENTS

| | | | |
|---|---|---|---|
| 169181 | 1/1986 | European Pat. Off. | 428/138 |
| 178353 | 4/1986 | European Pat. Off. | 428/138 |
| 923635 | 4/1963 | United Kingdom | 428/138 |
| 1378287 | 12/1974 | United Kingdom | 428/138 |
| 1385713 | 2/1975 | United Kingdom | 428/138 |

OTHER PUBLICATIONS 3,300,755, 1/1984, F.R.G. printed publication.
WO 86-04106, 7/1986, I.P.C. printed publication.

*Primary Examiner*—James C. Cannon
*Attorney, Agent, or Firm*—Pollock, Vande Sande & Priddy

[57] ABSTRACT

Sheet of roofcovering material, consisting of a porous base layer provided with apertures distributed over its surface, over which base layer a bituminous covering layer has been applied under insertion of a perforated plastic film so that the covering layer is adhered to the base layer through the perforations of the film, such, that by the exceeding of a certain shear stress between the base layer and the covering layer, the bituminous bond of the base layer with the covering layer on the spots of the perforations is torn loose coupled with a shifting of the base layer and the covering layer with respect to each other.

11 Claims, 1 Drawing Sheet

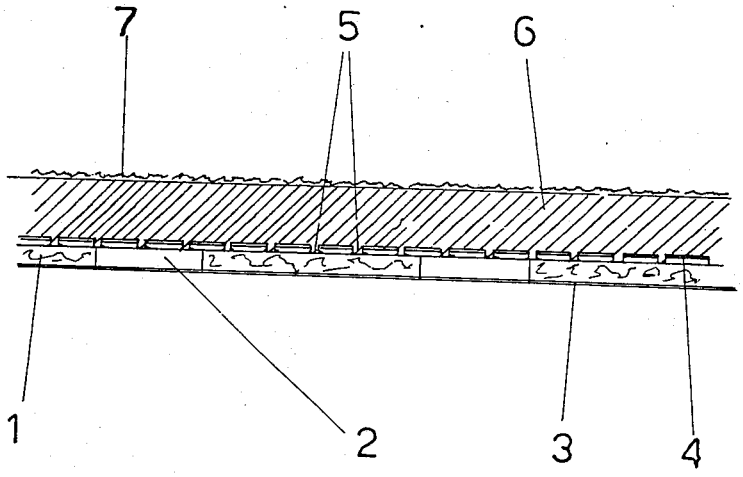
7
5
6
1
2
3
4

SHEET OF ROOFCOVERING MATERIAL

The invention relates to a sheet of roofcovering material, consisting of a porous base layer, particularly of glass fibers, and which base layer is provided with apertures distributed over its surface, while onto this base layer a bituminous covering layer has been applied.

Such a sheet of roofcovering material is generally known.

To apply this known roofcovering material onto for instance a roof plane, the bituminous covering layer partly is molten on the spots of the apertures in the base layer, after which this molten material may get adhered to the roof plane and in this way the roof covering material is applied onto the roof plane.

In a suitable manner the roof covering material may be unrolled from the roll onto the roof plane, while, at the same time, the lower side of the material immediately upstream of the line of contact of the roll with the roof plane is heated by means of one or more burners.

In doing so, the flame of the burner or the burners may come in touch with the bituminous covering layer only immediately through the apertures in the base layer, to melt there the bituminous material, so that by further unrolling of the roofcovering material over the roof plane, this roofcovering material gets adhered to the roof plane only on the spots of the apertures in the base layer.

With the known roofcovering material, often the drawback is encountered that, when the roofcovering material is applied onto a roof plane in which fissures or cracks may be formed, or which the roof plane under the influence of moisture and/or heat may expand or may shrink, thus, in other words, is subjected to workings, that the bituminous covering layer is not able to follow the movements of the base layer adhered to the roof plane, and then locally may crack, causing leakages.

It is an object of the invention to obviate this drawback of the known sheet of roof covering material.

The sheet of roof covering material according to the invention shows thereto the feature, that the covering layer under insertion of a perforated plastic film is applied over the base layer, and is adhered to this base layer through the perforations of this plastic film, thus, that by exceeding a certain shear stress between the base layer and the covering layer, the bituminous bond on the spots of the perforations is torn loose, during which the base layer and the covering layer shift with respect to each other.

As contrasted to the known roofcovering material, the bituminous covering layer of the sheet of roof covering material according to the invention comes to lie loose on the base layer by the exceeding of a certain shear stress between the base layer and the covering layer, and then is not forced any more to follow there the movements of the base layer, so that it is prevented, that in the bituminous covering layer cracks may be formed.

By the size of the perforations in the plastic film and the number of perforations per unit of surface, the limiting value of the shear stress may be chosen in a very exact way, at which the covering layer will be torn free from the base layer to become lying loose over the base layer.

In a suitable embodiment of the roofcovering material according to the invention, the base layer is provided on its side turned away from the covering layer, with a heat resistant or fireproof protective layer.

The heat resistant—or fireproof protective layer effects, that, when applying and at the same time heating the lower side of the roof covering material, only the material of the bituminous covering layer on the spots of the apertures in the base layer is molten, during which the permeability of the porous base layer for vapor and moisture remains unaffected.

This permeability for vapor and moisture is of special importance because, when moisture and vapor should be enclosed or trapped underneath the roofcovering material and then could not escape any more, such may cause the forming of blisters in the applied roofcovering material. The apertures spaced over the surface of the base layer may have a section with a surface of 1 $cm^2$ to 100 $cm^2$.

Preferably a section surface of the apertures is applied of about 6 $cm^2$. In a suitable embodiment of the invented roof covering material the rows of apertures enclose an angle with the logitudinal direction of the sheet or the band, that is to say, with a side edge of the sheet or the band, different from 0° and 90°, and more in particular has a value between 5°–15° and 75°–°.

By this measure it is achieved, that a row of apertures may not entirely come to lie over a crack in the roof plane generally extending according to the transverse of longitudinal direction of the sheet of roofcovering material.

For covering up cracks formed in the roof plane, suitably a sheet or band of roofcovering material may be applied, consisting of a porous base layer, particularly of glass fibers, onto which a bituminous covering layer is applied, and in which the covering layer under insertion of a perforated plastic film is applied over the narrower base layer and extends sideways with two side strips over the base layer. By means of the sidestrips the roofcovering material according to this embodiment then may be adhered to the roof plane.

In the accompanying drawing an embodiment of the invention is illustrated by way of example.

As is shown in the drawing, the sheet of roof covering material according to this embodiment is formed by a base layer 1, of non-woven glassfibers and which, distributed over its surface, is provided with apertures 2.

On its lower side, the base layer is provided with a heat resistant or fire proof protective layer 3.

Over the base layer 1, a perforated plastic film 4 has been applied separating the base layer from the bituminous covering layer as applied over the film 4, however such with the exception of the perforations 5 of the film through which the material of the covering layer 6 has come in touch with the base layer 1, and has gotten there adhered to the base layer, and by means of which a limited bond of the bituminous covering layer 6 with the base layer 1 has been effected.

This bond may be torn loose across the perforations when a certain shear stress arises between the base layer and the covering layer.

The high-elastic covering layer, preferably consisting of 80% bitumen and 20% SBS (styrene-butadiene-styrene) further is provided with a top layer 7 of slate-chippings.

I claim:

1. Sheet of roofcovering material containing a porous base-layer having apertures distributed over its surface, and a bituminous covering layer over said base-layer wherein inserted between said porous base-layer and bituminous covering layer and over said base-layer is a perforated plastic film, the bituminous covering layer being adhered to said porous base-layer through the perforations of the perforated plastic film, whereby exceeding a certain shear stress between said base layer and said covering layer, the bituminous bond of the base layer with the covering layer present on the spots of the perforations is torn loose, during which said base layer and said covering layer shift with respect to each other.

2. Sheet of roofcovering material as claimed in claim 1, characterized in that the base layer at its side turned away from the covering layer is provided with a heat resistant- or fireproof protective layer.

3. Sheet of roofcovering material as claimed in claim 2, characterized in that the heat resistant- or fireproof layer is permeable to gas and water vapor.

4. The sheet of roofcovering material of claim 1 wherein said base-layer is of non-woven fiberglass.

5. Sheet of roofcovering material as claimed in one of the claims 1, 2, and 3, characterized in that the apertures distributed over the base layer have a varying section surface from 1 $cm^2$ to 100 $cm^2$.

6. The sheet of roofcovering material of claim 5 wherein said base layer has a varying section surface of 6 $cm^2$.

7. Sheet of roofcovering material of claim 5, characterized in that the rows of apertures enclose with the longitudinal direction of the sheet an angle which differs from 0° and 90°.

8. Sheet of roofcovering material as claimed in one of the claims 1, 2, and 3, characterized in that the rows of apertures enclose with the longitudinal direction of the sheet an angle which differs from 0° and 90°.

9. The sheet of roofcovering material of claim 8 wherein the rows of apertures enclose with the longitudinal direction of the sheet an angle lying between 5°-15° and 75°-85°.

10. Sheet of roofcovering material containing a porous baselayer having apertures distributed over its surface and a bituminous covering layer over said base-layer wherein inserted between said porous base-layer and bituminous covering layer and over said base-layer is a perforated plastic film, the bituminous covering layer being adhered to said porous base-layer through the perforations of said perforated plastic film, and wherein said covering layer has been applied over the narrower base-layer and extends in two side strips sideways over the base-layer by means of which side strips, which are not covered by the base-layer, the sheet of roofcovering material may be adhered onto a roof shape.

11. The sheet of roofcovering material of claim 10 wherein said porous base-layer is non-woven glass fiber.

* * * * *